US009457979B2

(12) United States Patent
Hou et al.

(10) Patent No.: US 9,457,979 B2
(45) Date of Patent: Oct. 4, 2016

(54) BANKNOTE PRESSING DEVICE

(71) Applicant: SHENZHEN BROADZONE INTELLIGENCE TECHNOLOGY CO., LTD., Shenzhen, Guangdong (CN)

(72) Inventors: Lanzhong Hou, Guangdong (CN); Chengwu Gu, Guangdong (CN)

(73) Assignee: SHENZHEN BROADZONE INTELLIGENCE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/765,568

(22) PCT Filed: Sep. 17, 2014

(86) PCT No.: PCT/CN2014/086696

§ 371 (c)(1),
(2) Date: Aug. 3, 2015

(87) PCT Pub. No.: WO2015/058601

PCT Pub. Date: Apr. 30, 2015

(65) Prior Publication Data

US 2015/0368057 A1 Dec. 24, 2015

(30) Foreign Application Priority Data

Oct. 24, 2013 (CN) ..... 2013 1 0505761

(51) Int. Cl.

| | |
|---|---|
| ***B65H 31/26*** | (2006.01) |
| ***B65H 29/38*** | (2006.01) |
| ***B65H 31/10*** | (2006.01) |
| ***B65H 29/44*** | (2006.01) |

(52) U.S. Cl.

CPC ..... *B65H 29/38* (2013.01); *B65H 29/44* (2013.01); *B65H 31/10* (2013.01); *B65H 31/26* (2013.01); *B65H 2404/63* (2013.01); *B65H 2405/115* (2013.01); *B65H 2701/1912* (2013.01)

(58) Field of Classification Search

CPC ..... B65H 1/04; B65H 1/12; B65H 9/00; B65H 9/10; B65H 9/101; B65H 9/103; B65H 29/26; B65H 29/34; B65H 29/38; B65H 29/40; B65H 29/42; B65H 29/44; B65H 29/46; B65H 29/70; B65H 31/10; B65H 2404/60; B65H 2404/61; B65H 2404/63; B65H 2404/70; B65H 2404/74; B65H 2404/741; B65H 2404/7414; B65H 2405/321; B65H 2405/35; B65H 2405/352; B65H 2405/353; B65H 2701/1912; B65H 2405/115

USPC ..... 271/209, 220

See application file for complete search history.

(56) References Cited

U.S. PATENT DOCUMENTS

| | | | | |
|---|---|---|---|---|
| 4,938,657 A * | 7/1990 | Benson | B65G 57/06 | 271/188 |
| 6,244,589 B1 * | 6/2001 | Gerlier | B65H 29/44 | 271/177 |
| 8,042,803 B2 * | 10/2011 | Lee | B65H 29/14 | 271/177 |
| 8,167,301 B2 * | 5/2012 | Nireki | B65H 29/46 | 271/180 |
| 8,672,316 B2 * | 3/2014 | Chiwata | B65H 31/02 | 271/161 |

FOREIGN PATENT DOCUMENTS

| | | |
|---|---|---|
| CN | 101855654 A | 10/2010 |
| JP | 6-156844 A | 6/1994 |

OTHER PUBLICATIONS

International Search Report of PCT Patent Application No. PCT/CN2014/086696 issued on Nov. 28, 2014.

* cited by examiner

*Primary Examiner* — Prasad Gokhale

(57) ABSTRACT

The present invention discloses a banknote pressing device, including a banknote blocking mechanism (10), and a left banknote pressing plate (20) and a right banknote pressing plate (30), wherein the left banknote pressing plate (20) includes a movable A end (21) and a B end (22), the right banknote pressing plate (30) includes a movable C end (31) of the right banknote pressing plate and a D end (32) of the right banknote pressing plate, the movable A end (21) of the left banknote pressing plate (20) and the movable C end (31) of the right banknote pressing plate (30) can be synchronously opened, closed and swung with the B end (22) and the D end (32)-as rotating centers, respectively, and a spring (51) and a banknote stacking plate (41) are further arranged below the left banknote pressing plate (20) and the right banknote pressing plate (30).

6 Claims, 12 Drawing Sheets

BANKNOTE PRESSING DEVICE

TECHNICAL FIELD

The present invention relates to a banknote pressing device, and particularly to a banknote pressing device which can trimly stack and store multiple batches of banknotes.

BACKGROUND

With the development of science and technology, in order to meet the requirements of people on convenience and rapidness, vending machines, currency exchange machines or cash deposit machines and the like are set in a lot of public places at present, greatly saving the configuration of manpower resources. As the key components of the foregoing vending machines, currency exchange machines or cash deposit machines and the like, currency note storage devices are widely used in the commercial field. The currency note storage devices are divided into coin storage devices and banknote storage devices. Since the currency values of coins are smaller, the application range of the coin storage devices is relatively narrow, and compared with the coin storage devices, the application range of the banknote storage devices is wider. Due to unreasonable structural design, the existing conventional banknote storage devices cannot trimly stack banknotes which are input for multiple times, and the banknote storage devices also cannot store a larger number of banknotes, or although the foregoing functions and purpose can be fulfilled, the structures are complicated and the sizes are huge, resulting in greatly increased product cost, so that due to the high cost, the banknote storage devices cannot be widely used on common outdoor unattended equipment, for example, such banknote consumption financial equipment as the vending machines, currency exchange machines and the like.

SUMMARY

The technical problem to be solved in the present invention is to provide a banknote pressing device, which can trimly stack and store multiple batches of banknotes.

To solve the above technical problem, the technical solution of the present invention is as follows: the banknote pressing device mainly includes a banknote blocking mechanism, and a left banknote pressing plate and a right banknote pressing plate which are arranged below the two sides of the banknote blocking mechanism, wherein the left banknote pressing plate includes a movable A end of the left banknote pressing plate close to the banknote blocking mechanism and a B end of the left banknote pressing plate, the right banknote pressing plate includes a movable C end of the right banknote pressing plate close to the banknote blocking mechanism and a D end of the right banknote pressing plate, the movable A end of the left banknote pressing plate and the movable C end of the right banknote pressing plate can be synchronously opened, closed and swung with the B end of the left banknote pressing plate and the D end of the right banknote pressing plate as rotating centers, respectively, and a spring and a banknote stacking plate are further arranged below the left banknote pressing plate and the right banknote pressing plate.

As the first improvement of the present invention, the movable A end of the left banknote pressing plate and the movable C end of the right banknote pressing plate are synchronously rotated around the B end of the left banknote pressing plate and the D end of the right banknote pressing plate respectively.

As a further improvement of the present invention, the left banknote pressing plate and the right banknote pressing plate can be synchronously operated.

As the second improvement of the present invention, the banknote pressing device further includes a box body enclosing at an outside of the banknote blocking mechanism, the left banknote pressing plate, the right banknote pressing plate, the banknote stacking plate and the spring. The B end of the left banknote pressing plate and the D end of the right banknote pressing plate are hinged with the box body.

As a further improvement of the present invention, the banknote pressing device further includes a first connecting rod connected with the movable A end of the left banknote pressing plate and a second connecting rod connected with the movable C end of the right banknote pressing plate, and when the first connecting rod and the second connecting rod move up and down, the left banknote pressing plate and the right banknote pressing plate can be driven to synchronously open and close. The movable A end of the left banknote pressing plate is connected with a first turntable through the first connecting rod, and the movable C end of the right banknote pressing plate is connected with a second turntable through the second connecting rod.

As a further improvement of the present invention, the first turntable and the second turntable are synchronously rotated.

Preferably, the first turntable and the second turntable are synchronously rotated through engaged gears.

By implementing the present invention, the following beneficial effects can be achieved:

the banknote pressing device mainly includes the banknote blocking mechanism, and the left banknote pressing plate and the right banknote pressing plate which are arranged below the two sides of the banknote blocking mechanism, the left banknote pressing plate includes the movable A end of the left banknote pressing plate close to the banknote blocking mechanism and the B end of the left banknote pressing plate, the right banknote pressing plate includes the movable C end of the right banknote pressing plate close to the banknote blocking mechanism and the D end of the right banknote pressing plate, the movable A end of the left banknote pressing plate and the movable C end of the right banknote pressing plate can be synchronously opened, closed and swung with the B end of the left banknote pressing plate and the D end of the right banknote pressing plate as rotating centers, respectively, and the spring and the banknote stacking plate are further arranged below the left banknote pressing plate and the right banknote pressing plate. A banknote will drop onto the left and right banknote pressing plates after entering the banknote pressing device, the movable A end of the left banknote pressing plate and the movable C end of the right banknote pressing plate rise up, the middle part of the banknote will be blocked by the banknote blocking mechanism and the banknote fails to move upwards continuously, the left and right parts of the banknote are respectively folded upwards by the movable A end of the left banknote pressing plate and the movable C end of the right banknote pressing plate, the movable A end of the left banknote pressing plate and the movable C end of the right banknote pressing plate continue to move upwards, when moving to the highest point, the movable A end of the left banknote pressing plate and the movable C end of the right banknote pressing plate leave the edge of the banknote, the banknote is bounced back to the lower side of the left banknote pressing plate and the right banknote pressing plate, at this time, the left banknote pressing plate and the right banknote pressing plate will descend, the banknote is pressed below the left and right banknote pressing plates, and when the movable A end of the left banknote pressing plate and the movable C end of the right banknote pressing plate move downwards and return to the initial state, the banknote will be trimly stacked on the banknote stacking plate. Multiple batches of banknotes are trimly stacked and stored, and the spring will apply a force to the banknote stacking plate to press the stored banknotes, so as to ensure the stacking trimness of the banknotes. The movable A end of the left banknote pressing plate can rotate around the B end of the left banknote pressing plate, the movable C end of the right banknote pressing plate can rotate around the D end of the right banknote pressing plate. In an ascending process of the left banknote pressing plate and the right banknote pressing plate, the gap between the movable A end of the left banknote pressing plate and the movable C end of the right banknote pressing plate gradually becomes larger, so as to ensure not to damage the banknotes due to too severe creases of the banknotes. The movable A end of the left banknote pressing plate is connected with the first connecting rod, the movable C end of the right banknote pressing plate is connected with the second connecting rod, and when the connecting rods move up and down, the left banknote pressing plate and the right banknote pressing plate can be driven to synchronously open and close. The movable A end of the left banknote pressing plate is connected with the first turntable through the first connecting rod, the movable C end of the right banknote pressing plate is connected with the second turntable through the second connecting rod, the first turntable and the second turntable are synchronously rotated, and the first turntable and the second turntable are synchronously rotated through the engaged gears. Due to this structure, the left banknote pressing plate and the right banknote pressing plate synchronously move to ensure that the force applied to the left and right sides of the banknotes is uniform in a banknote pressing process, so as to prevent the banknotes from deviating to one side to result in the condition that the banknotes cannot be stacked trimly and to facilitate subsequent checking and bundling of the banknotes. The banknote pressing device further includes the box body enclosing at the outside of the banknote blocking mechanism, the left banknote pressing plate, the right banknote pressing plate and the banknote stacking plate, the B end of the left banknote pressing plate is hinged with the box body, and the D end of the right banknote pressing plate is also hinged with the box body, due to this structure, the banknotes are trimly and stably stacked, meanwhile the structure of the banknote pressing device is simpler and more compact, and the space occupied by the equipment is greatly reduced, so that the banknote pressing device can be conveniently applied to outdoor unattended equipment.

BRIEF DESCRIPTION OF THE DRAWINGS

A further detailed description of the present invention will be given below in combination with accompanying drawings, wherein.

DETAILED DESCRIPTION OF THE EMBODIMENTS

Figure 1:
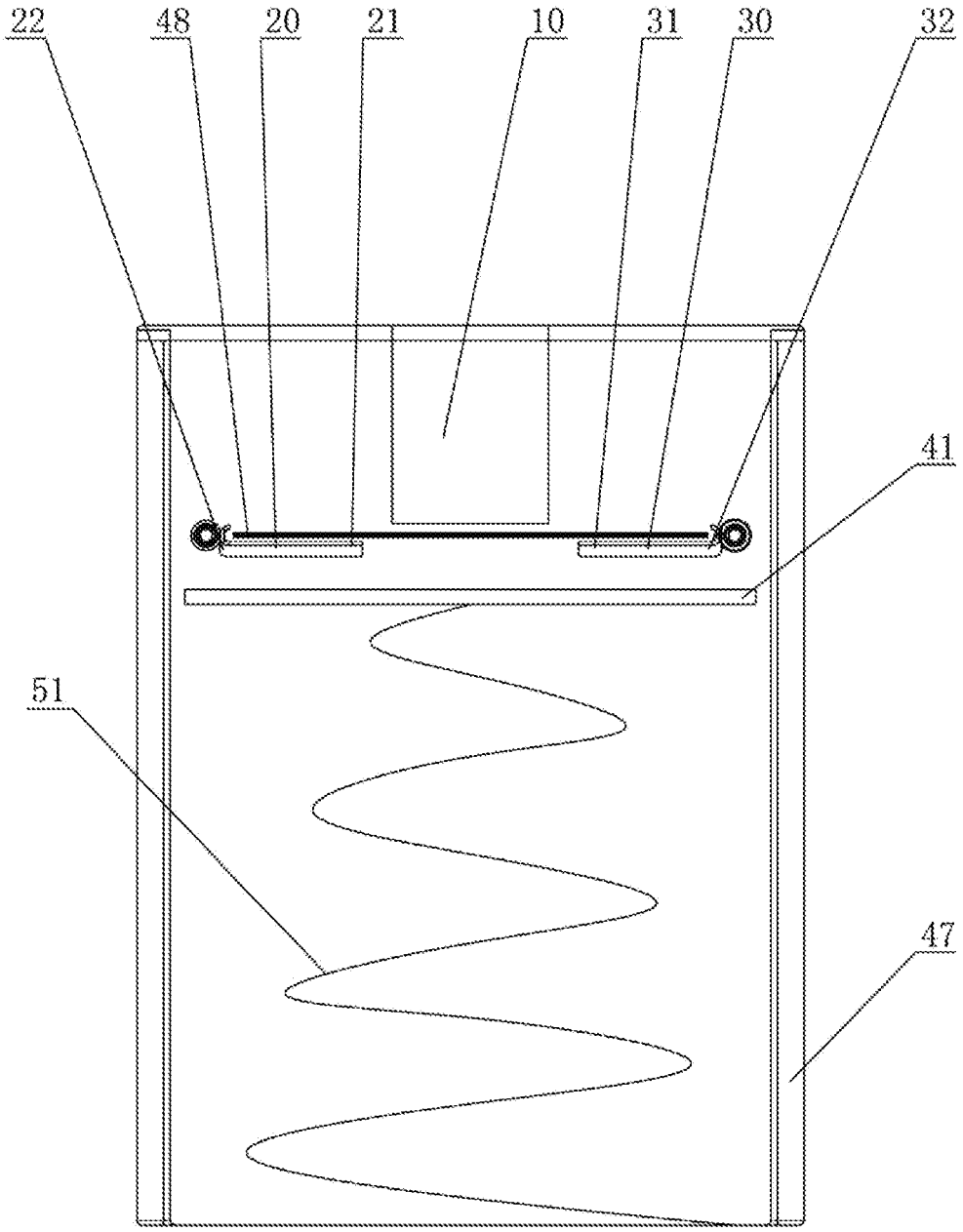
FIG. 1 is a first schematic diagram of a working state of the present invention.
Figure 2:
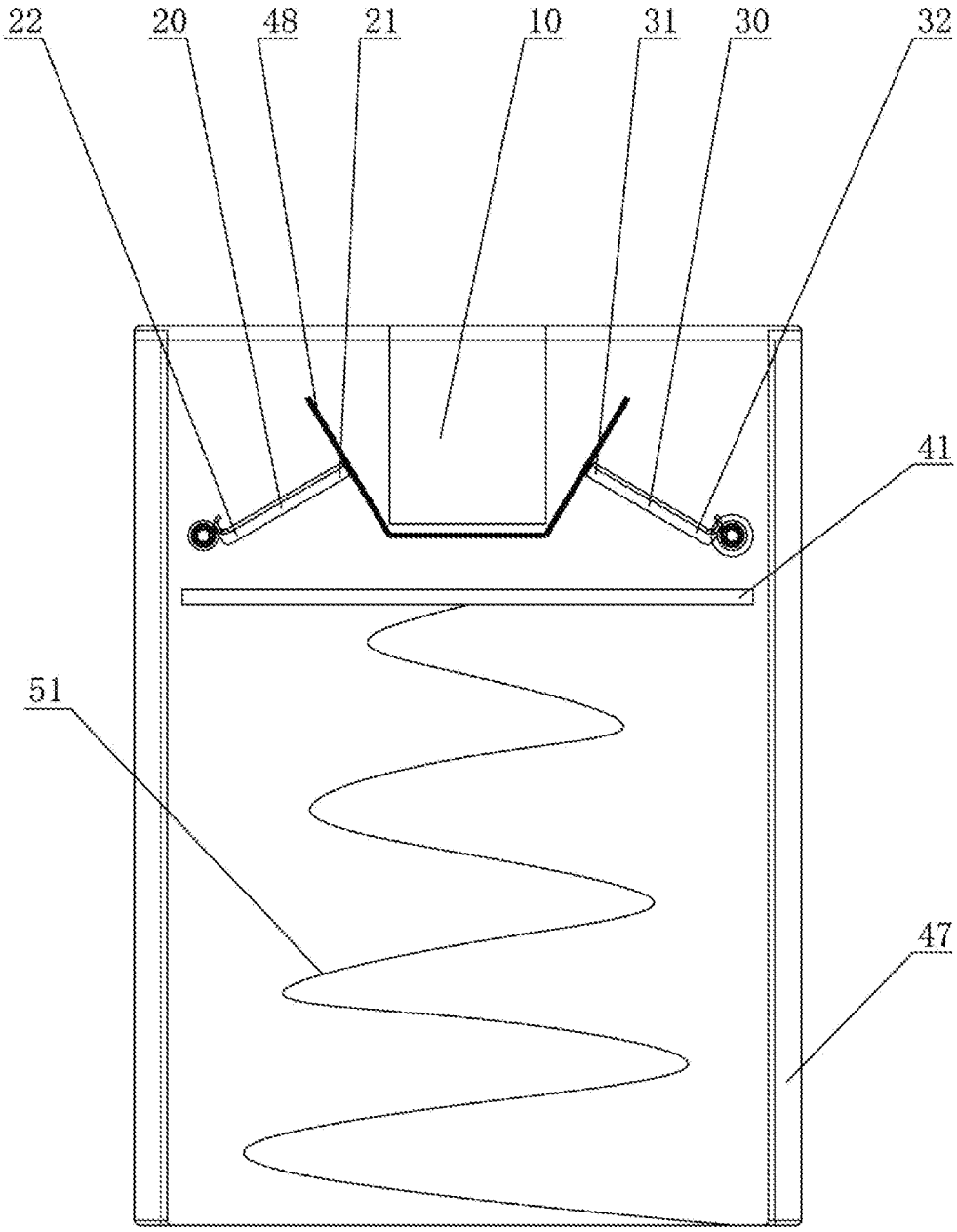
FIG. 2 is a second schematic diagram of a working state of the present invention.
Figure 3:
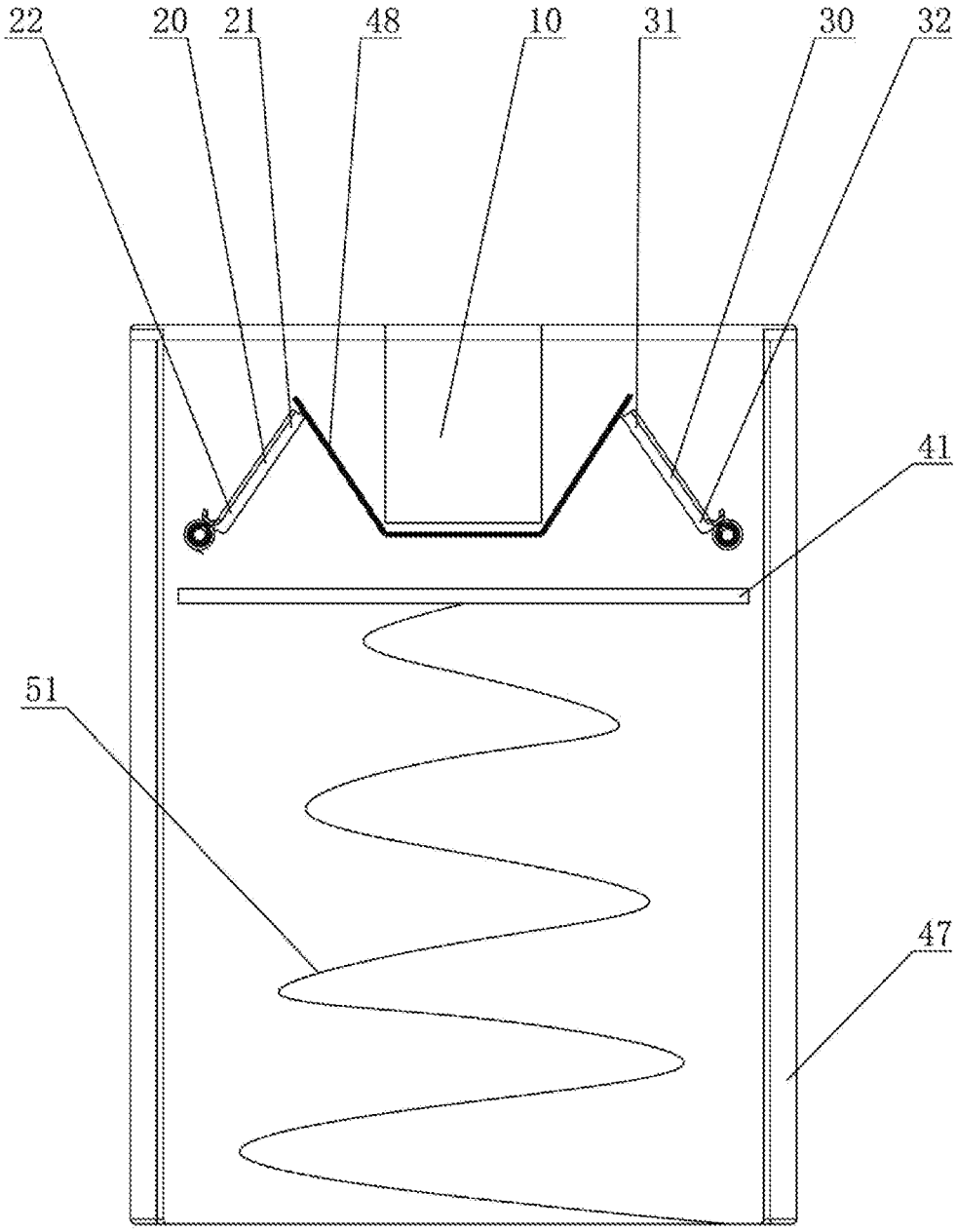
FIG. 3 is a third schematic diagram of a working state of the present invention.
Figure 4:
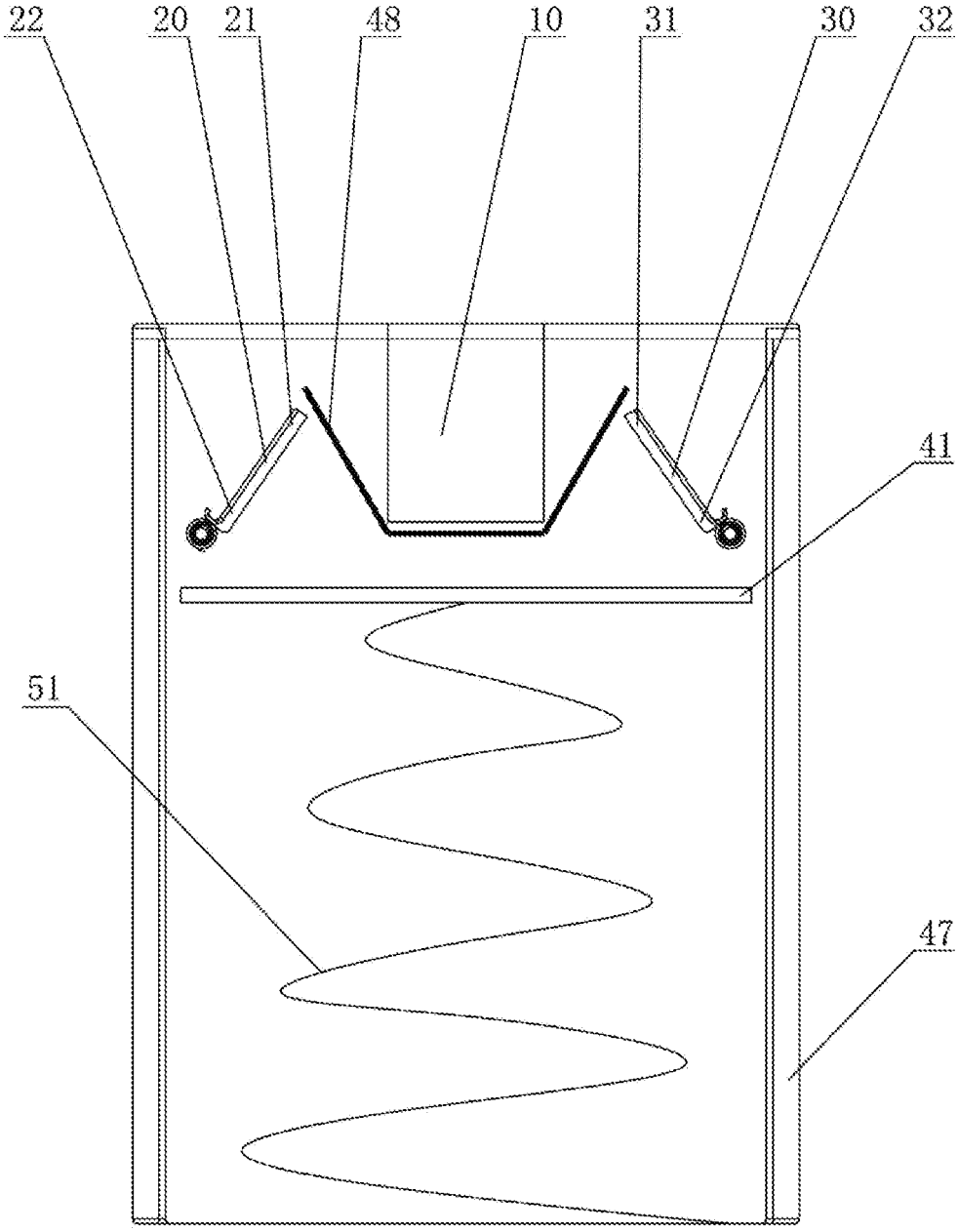
FIG. 4 is a fourth schematic diagram of a working state of the present invention.
Figure 5:
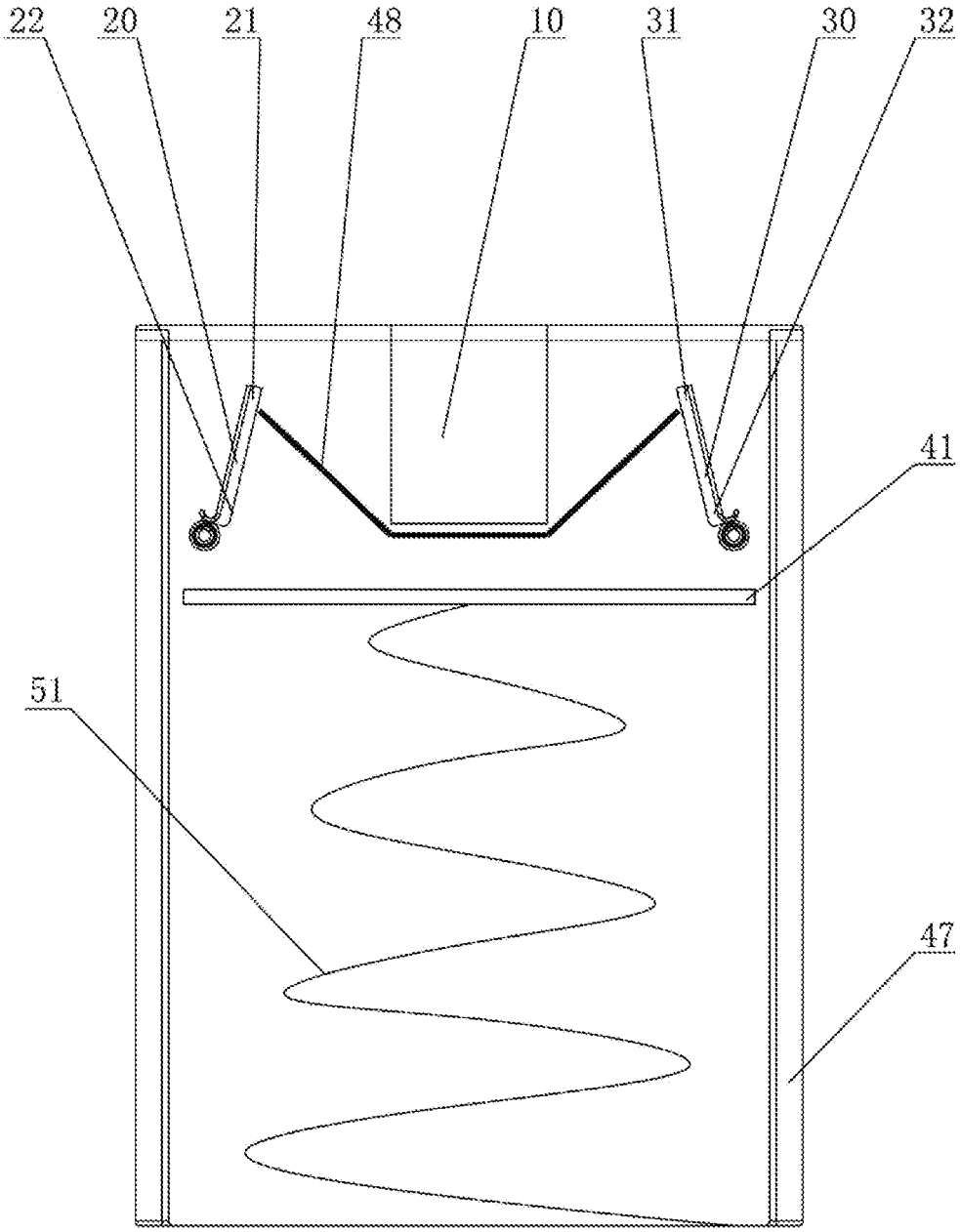
FIG. 5 is a fifth schematic diagram of a working state of the present invention.
Figure 6:
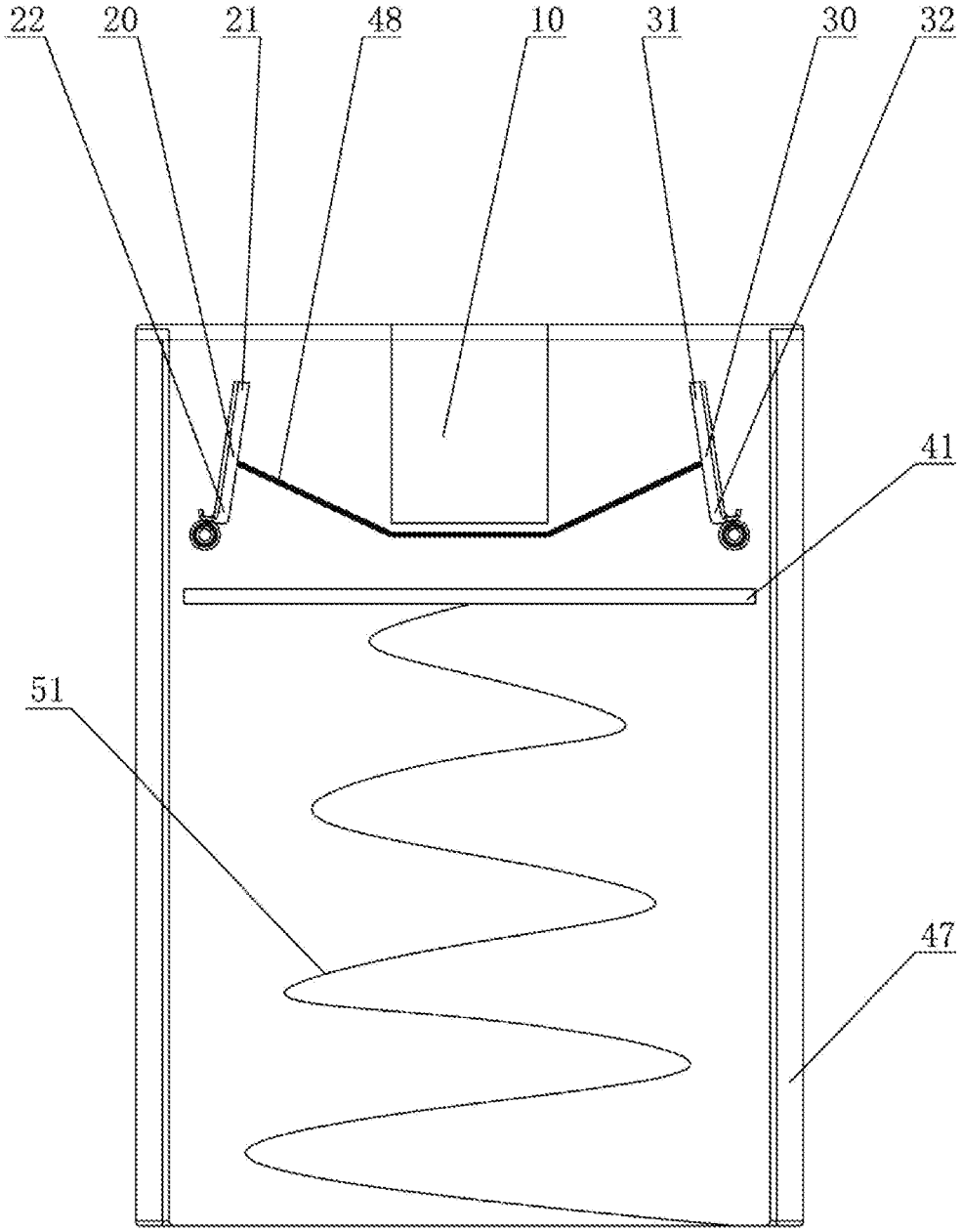
FIG. 6 is a sixth schematic diagram of a working state of the present invention.
Figure 7:
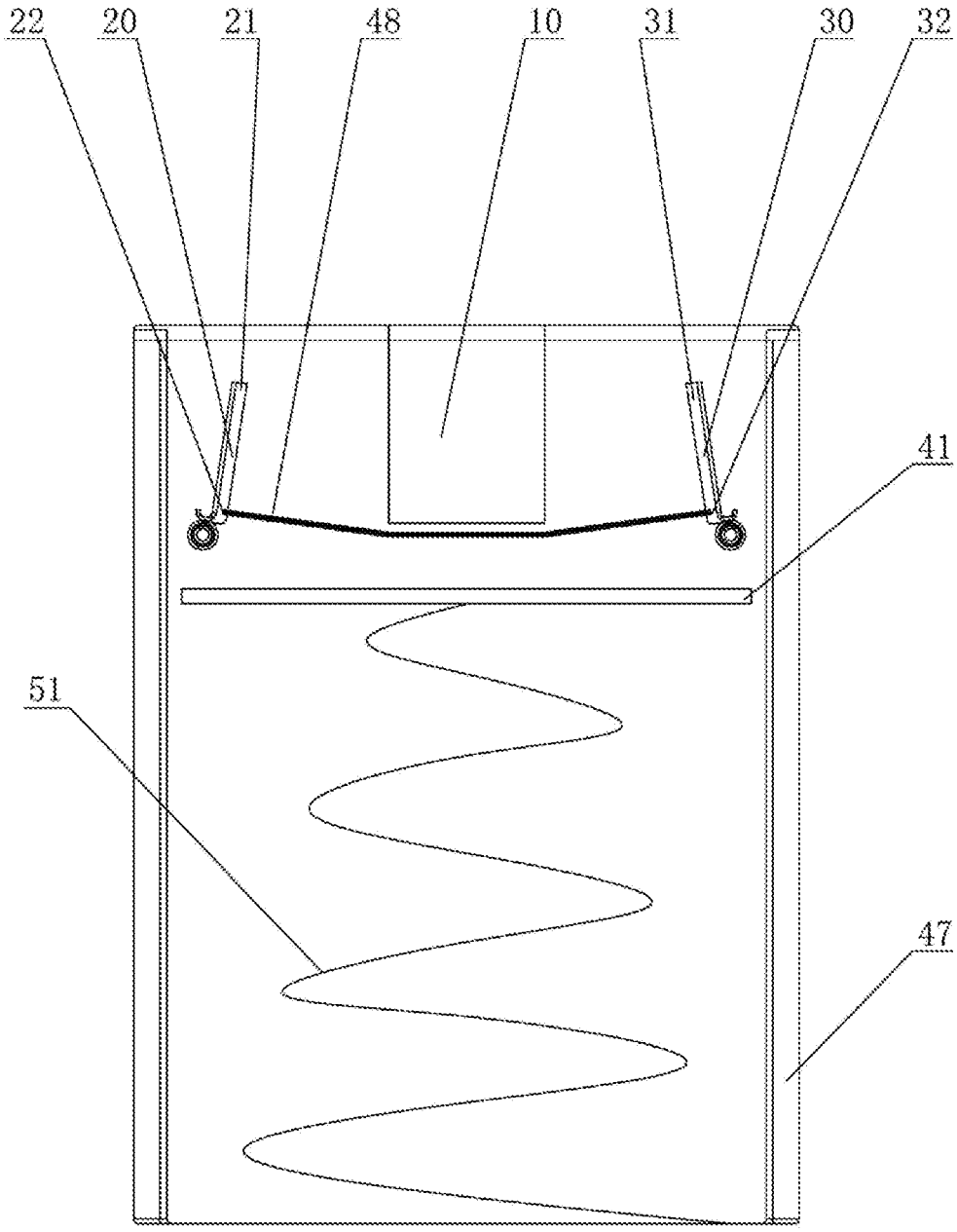
FIG. 7 is a seventh schematic diagram of a working state of the present invention.

As shown in FIG. 1, a banknote pressing device includes a banknote blocking mechanism 10, and a left banknote pressing plate 20 and a right banknote pressing plate 30 which are arranged below two sides of the banknote blocking mechanism 10, wherein the banknote blocking mechanism 10 can be of a plate-shaped structure, a blocky structure or a frame structure, the banknote blocking mechanism 10 in the present invention adopts the frame structure, and a spring 51 and a banknote stacking plate 41 are further arranged below the left banknote pressing plate 20 and the right banknote pressing plate 30. The left banknote pressing plate 20 includes a movable A end 21 of the left banknote pressing plate close to the banknote blocking mechanism 10 and a B end 22 of the left banknote pressing plate, and the right banknote pressing plate 30 includes a movable C end 31 of the right banknote pressing plate close to the banknote blocking mechanism 10 and a D end 32 of the right banknote pressing plate. The banknote pressing device further includes a box body 47 which encloses an outside of the banknote blocking mechanism 10, the left banknote pressing plate 20, the right banknote pressing plate 30, the banknote stacking plate 41 and the spring 51. The B end 22 of the left banknote pressing plate 20 and the D end 32 of the right banknote pressing plate 30 are hinged with the box body 47.

As shown in FIG. 2 to FIG. 7, the movable A end 21 of the left banknote pressing plate 20 and the movable C end 31 of the right banknote pressing plate 30 synchronously rotate around the B end 22 of the left banknote pressing plate and the D end 32 of the right banknote pressing plate respectively, the movable A end 21 of the left banknote pressing plate and the movable C end 31 of the right banknote pressing plate will fold the left and right ends of a banknote, and the middle part of the banknote will be blocked by the banknote blocking mechanism 10 and the banknote fails to move upwards. When the banknote 48 leaves the left and right banknote pressing plates, the folded parts on the two sides will drop due to the deformation recovery capacity of the banknote 48, and at this time, the folded parts on the two sides of the banknote 48 are located below the left and right banknote pressing plates.

Figure 8:
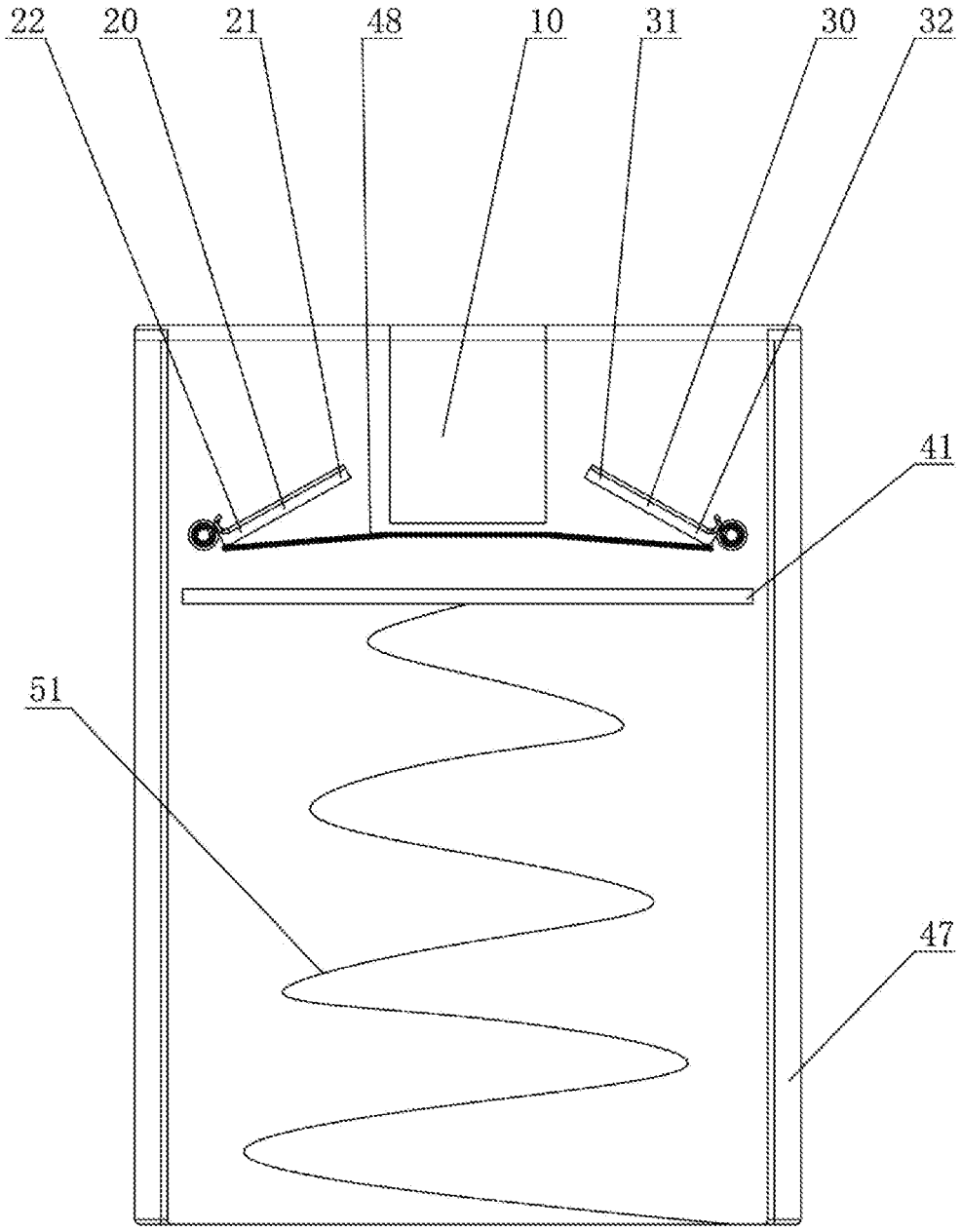
FIG. 8 is an eighth schematic diagram of a working state of the present invention.
Figure 9:
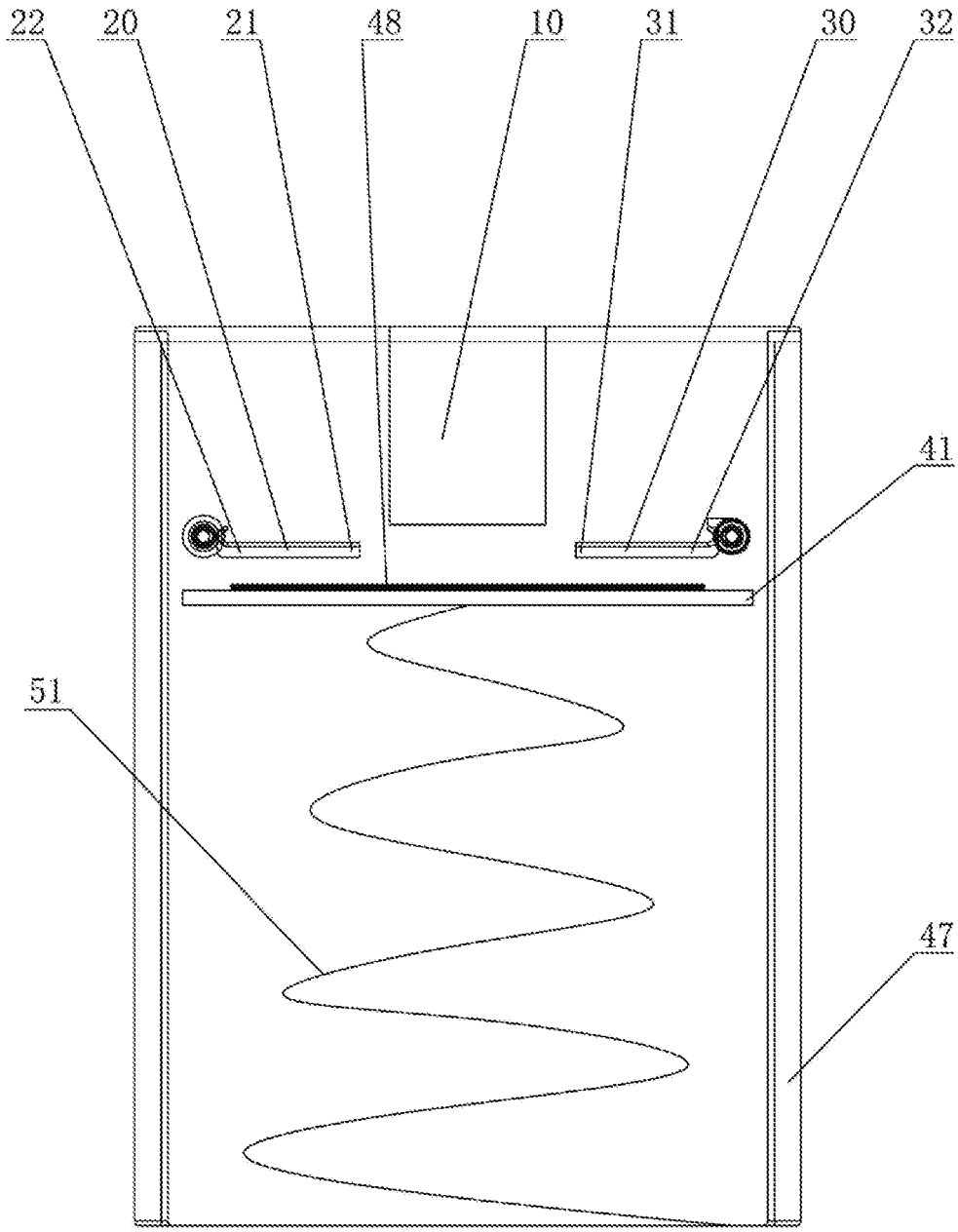
FIG. 9 is a ninth schematic diagram of a working state of the present invention.

As shown in FIG. 8 or FIG. 9, the movable A end 21 of the left banknote pressing plate 20 and the movable C end 31 of the right banknote pressing plate 30 change the movement direction and move downwards, finally the left banknote pressing plate 20 and the right banknote pressing plate 30 will return to initial positions, and the lower surface of the left banknote pressing plate 20 and the lower surface of the right banknote pressing plate 30 will touch the banknote 48 and completely and trimly press the banknote 48 on the banknote stacking plate 41. Banknotes are pressed by the circular actions, so that multiple batches of banknotes 48 can be trimly stacked and stored together.

Figure 10:
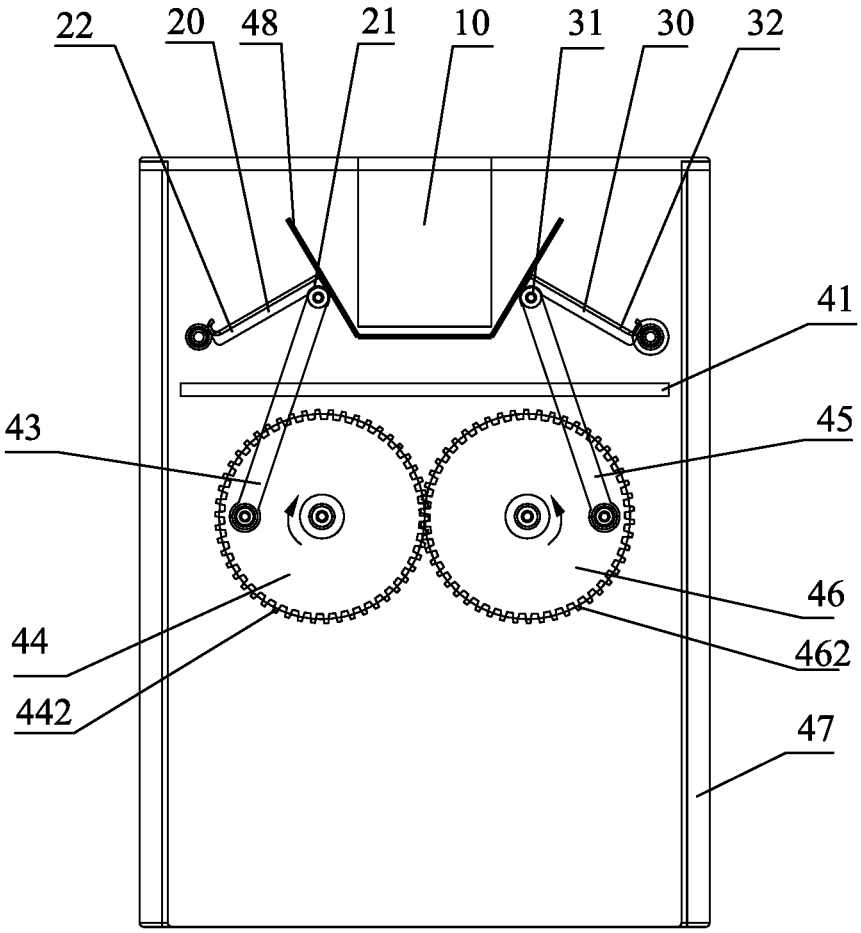
FIG. 10 is a schematic diagram of a working state when a transmission manner of a turntable and a connecting rod is adopted in the present invention.

As shown in FIG. 10, the movable A end 21 of the left banknote pressing plate 20 rotates around the B end 22 of the left banknote pressing plate and/or the movable C end 31 of the right banknote pressing plate 30 rotates around the D end 32 of the right banknote pressing plate, and this can be achieved in any one of the following three manners: firstly: turntables are matched with connecting rods; secondly: a cylinder jacks and pulls the B end 22 of the left banknote pressing plate and the D end 32 of the right banknote pressing plate; and thirdly: an electromagnetic driving manner. The manner that the turntables are matched with the connecting rods is adopted in the embodiment; the specific structure is as follows: the movable A end 21 of the left banknote pressing plate 20 is connected with a first turntable 44 through a first connecting rod 43. The movable C end 31 of the right banknote pressing plate 30 is connected with a second turntable 46 through a second connecting rod 45, and the first turntable 44 and the second turntable 46 are synchronously rotated through engaged gears 442, 462. The synchronous rotation herein includes two rotation manners, namely synchronous rotation in the same direction and synchronous rotation in reverse directions, and the manner of synchronous rotation in reverse directions is adopted in the embodiment.

Figure 11:
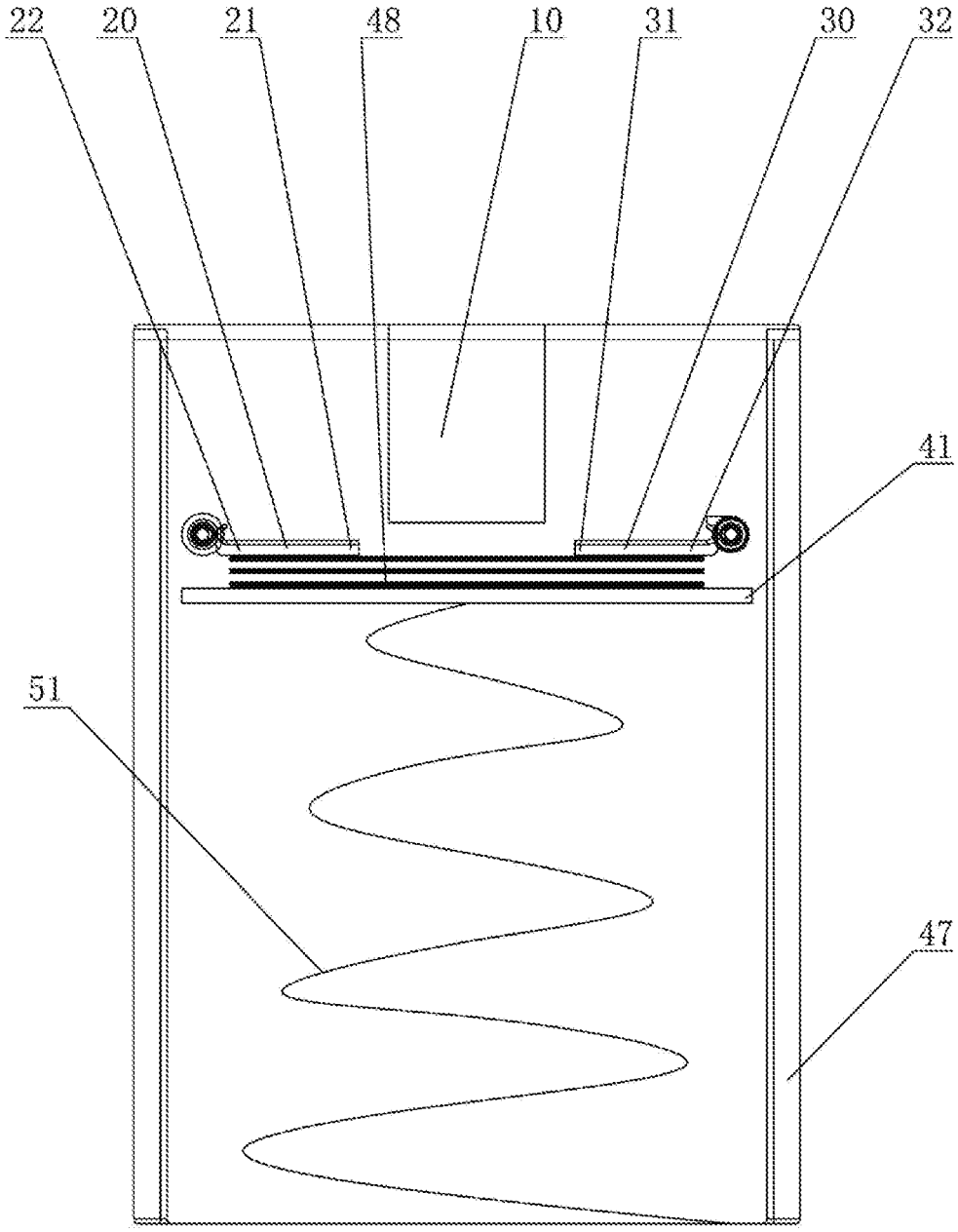
FIG. 11 is a schematic diagram of a status after multiple banknotes are stored in the present invention.

As shown in FIG. 11, with the increase of the thickness of the stored banknotes 48, the spring 51 arranged below the banknote blocking mechanism 10 will be compressed to provide a space for the stored banknotes 48, and meanwhile the spring 51 will apply a force to the banknote stacking plate 41 to press the stored banknotes 48, so as to ensure the stacking trimness of the banknotes.

Figure 12:
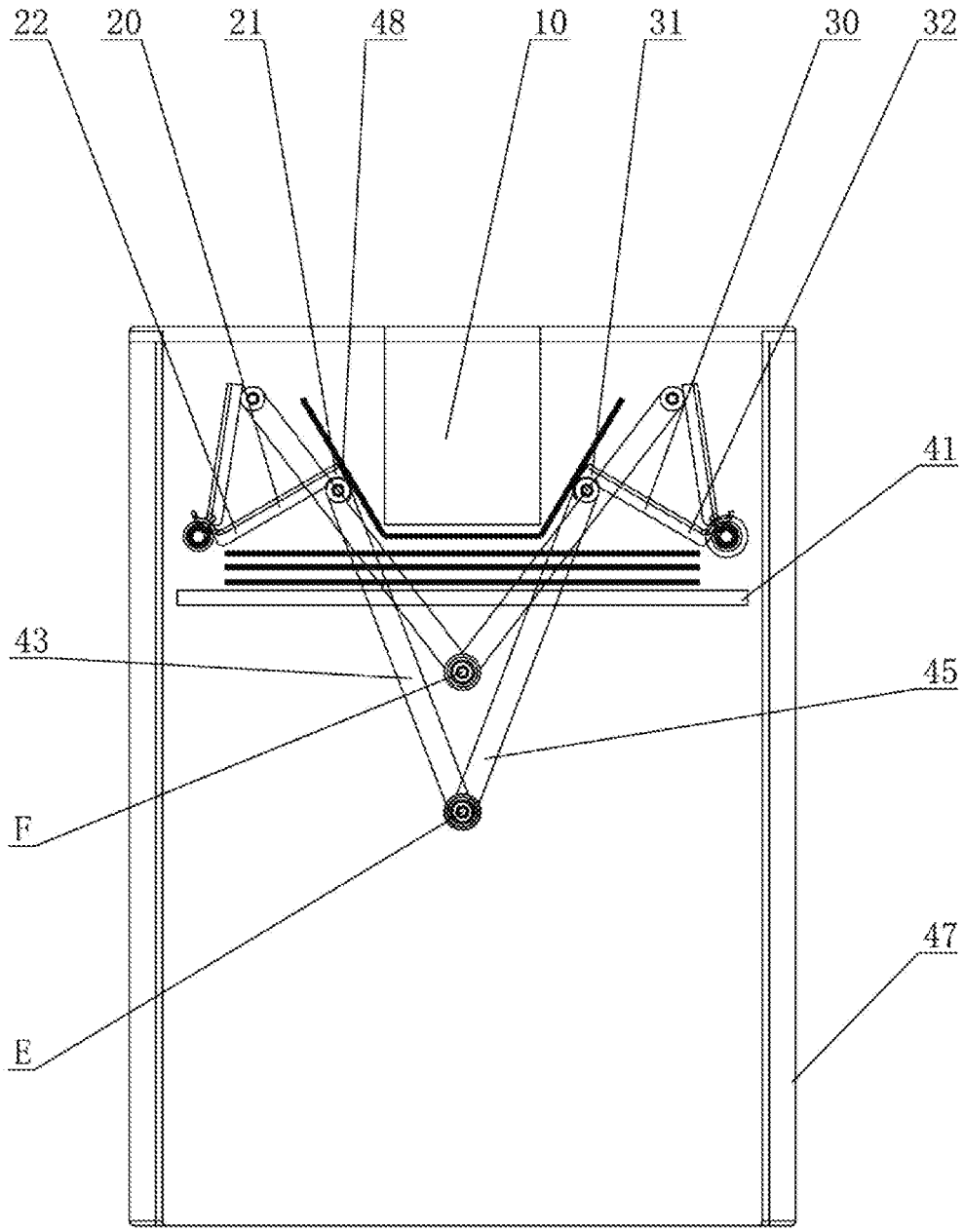
FIG. 12 is a schematic diagram of a working state when a transmission manner of directly propelling a connecting rod is adopted in the present invention.

As shown in FIG. 12, as another embodiment of the present invention, the movable A end 21 of the left banknote pressing plate 20 is connected with the first connecting rod 43, the movable C end 31 of the right banknote pressing plate 30 is connected with the second connecting rod 45, and when the first connecting rod 43 and the second connecting rod 45 move from an E position to an F position, the banknotes 48 move from the upper side of the left banknote pressing plate 20 and the right banknote pressing plate 30 to the lower side.

It should be noted that the above embodiments are merely some non-limiting illustrations of the present invention. But those skilled in the art should be aware that, modifications, substitutions and variations can be made to the present invention without departing from the spirit and scope of the present invention, and these modifications, substitutions and variations still belong to the protection scope of the present invention.

The invention claimed is:

1. A banknote pressing device comprising:

a banknote blocking mechanism (10), and a left banknote pressing plate (20) and a right banknote pressing plate (30) respectively arranged below two sides of the banknote blocking mechanism (10), wherein the left banknote pressing plate (20) comprises a movable A end (21) thereof close to the banknote blocking mechanism (10) and a B end (22) thereof, the right banknote pressing plate (30) comprises a movable C end (31) thereof close to the banknote blocking mechanism (10) and a D end (32) thereof, the movable A end (21) of the left banknote pressing plate (20) and the movable C end (31) of the right banknote pressing plate (30) are synchronously opened, closed and swung with the B end (22) of the left banknote pressing plate and the D end (32) of the right banknote pressing plate as rotating centers, respectively, and a spring (51) and a banknote stacking plate (41) are further arranged below the left banknote pressing plate (20) and the right banknote pressing plate (30);

wherein the banknote pressing device further comprises a box body (47), and an outside of the banknote blocking mechanism (10), the left banknote pressing plate (20), the right banknote pressing plate (30), the banknote stacking plate (41) and the spring (51) are enclosed by the box body (47);

wherein the B end (22) of the left banknote pressing plate (20) and the D end (32) of the right banknote pressing plate (30) are both hinged with the box body (47);

wherein the banknote pressing device further comprises a first connecting rod (43) connected with the movable A end (21) of the left banknote pressing plate (20) and a second connecting rod (45) connected with the movable C end (31) of the right banknote pressing plate (30), and when the first connecting rod (43) and the second connecting rod (45) move up and down, the left banknote pressing plate (20) and the right banknote pressing plate (30) are driven to synchronously open and close.

2. The banknote pressing device of claim 1, wherein the movable A end (21) of the left banknote pressing plate (20) and the movable C end (31) of the right banknote pressing plate (30) synchronously rotate around the B end (22) of the left banknote pressing plate and the D end (32) of the right banknote pressing plate respectively.

3. The banknote pressing device of claim 2, wherein the left banknote pressing plate (20) and the right banknote pressing plate (30) are synchronously operated.

4. The banknote pressing device of claim 1, wherein the movable A end (21) of the left banknote pressing plate (20) is connected with a first turntable (44) through the first connecting rod (43), and the movable C end (31) of the right banknote pressing plate (30) is connected with a second turntable (46) through the second connecting rod (45).

5. The banknote pressing device of claim 4, wherein the first turntable (44) and the second turntable (46) are synchronously rotated.

6. The banknote pressing device of claim 5, wherein the first turntable (44) and the second turntable (46) are synchronously rotated through engaged gears.

* * * * *